US008597077B2

(12) United States Patent
Gane et al.

(10) Patent No.: US 8,597,077 B2
(45) Date of Patent: Dec. 3, 2013

(54) ALKALINE EARTH CARBONATE CONTAINING MINERAL FOR SURFACE CLEANING

(75) Inventors: Patrick A. C. Gane, Rothrist (CH); Matthias Buri, Rothrist (CH); Michael Skovby, Meilen (CH)

(73) Assignee: Omya International AG, Oftringen (CH)

( * ) Notice: Subject to any disclaimer, the term of this patent is extended or adjusted under 35 U.S.C. 154(b) by 516 days.

(21) Appl. No.: 12/736,663

(22) PCT Filed: Apr. 30, 2009

(86) PCT No.: PCT/EP2009/055273

§ 371 (c)(1), (2), (4) Date: Jan. 5, 2011

(87) PCT Pub. No.: WO2009/133173

PCT Pub. Date: Nov. 5, 2009

(65) Prior Publication Data

US 2011/0130076 A1 Jun. 2, 2011

Related U.S. Application Data

(60) Provisional application No. 61/126,656, filed on May 6, 2008.

(30) Foreign Application Priority Data

Apr. 30, 2008 (EP) ..... 08103796

(51) Int. Cl.
*B24B 1/00* (2006.01)

(52) U.S. Cl.
USPC ..... 451/39; 451/75; 241/24.1; 241/69

(58) Field of Classification Search
USPC ..... 451/38, 39, 40, 75; 51/293; 241/24.1, 241/24.3, 68, 69, 71
See application file for complete search history.

(56) References Cited

U.S. PATENT DOCUMENTS

| | | | | |
|---|---|---|---|---|
| 4,804,488 | A * | 2/1989 | Alvemarker | 51/298 |
| 5,112,406 | A | 5/1992 | Lajoie et al. | |
| 5,336,281 | A * | 8/1994 | Winston et al. | 51/307 |
| 5,380,347 | A * | 1/1995 | Winston et al. | 51/293 |
| 5,509,971 | A * | 4/1996 | Kirschner | 134/7 |
| 5,531,634 | A * | 7/1996 | Schott | 451/39 |

(Continued)

FOREIGN PATENT DOCUMENTS

| | | | |
|---|---|---|---|
| DE | 4222884 | A1 | 1/1994 |
| JP | 2006 326821 | A | 12/2006 |

(Continued)

OTHER PUBLICATIONS

The European Search Report dated Oct. 13, 2010 for European Application No. 08103796.2.

(Continued)

*Primary Examiner* — Eileen P. Morgan
(74) *Attorney, Agent, or Firm* — Amster, Rothstein & Ebenstein LLP

(57) ABSTRACT

The present invention relates to a dry blasting process for the cleaning of solid surfaces as well as special abrasive pigments suitable therefor and a method for their production.

45 Claims, 3 Drawing Sheets

(56) References Cited

U.S. PATENT DOCUMENTS

| | | | | |
|---|---|---|---|---|
| 5,827,114 | A | 10/1998 | Yam et al. | |
| 6,113,475 | A | 9/2000 | Masuda et al. | |
| 8,138,253 | B2 * | 3/2012 | Maeba et al. | 524/425 |
| 2007/0003465 | A1 * | 1/2007 | Huang | 423/335 |
| 2007/0117737 | A1 * | 5/2007 | Artiga Gonzalez et al. | 510/446 |

FOREIGN PATENT DOCUMENTS

| | | | |
|---|---|---|---|
| WO | WO 93/18863 | A | 9/1993 |
| WO | WO 94/07658 | A | 4/1994 |
| WO | WO 97/41975 | A | 11/1997 |
| WO | 03061908 | A1 | 7/2003 |
| WO | WO 2004/080656 | A | 9/2004 |

OTHER PUBLICATIONS

The International Search Report for PCT Application No. PCT/EP2009/055273.

The Written Opinion of the International Searching Authority for PCT Application No. PCT/EP2009/055273.

* cited by examiner

ALKALINE EARTH CARBONATE CONTAINING MINERAL FOR SURFACE CLEANING

This is a U.S. national phase of PCT Application No. PCT/EP2009/055273, filed Apr. 30, 2009, which claims priority of European Application No. 08103796.2, filed Apr. 30, 2008 and U.S. Provisional Application No. 61/126,656, filed May 6, 2008.

The present invention relates to a dry blasting process for the cleaning of solid surfaces as well as to special abrasive pigments suitable therefor and a method for their production.

Blast cleaning, also called sand blasting or bead blasting is a generic term for the process of smoothing, shaping and cleaning a hard surface by forcing solid particles across that surface at high speeds using compressed air. The effect is similar to that of using sandpaper, but provides a more even finish with no problems at corners or crannies.

There is a continuous search for new materials and improved techniques of blast cleaning due to numerous disadvantages of the materials previously used. Historically, the material used for sandblasting was sand that had been sieved to a uniform size. However the silica dust produced in the sandblasting process caused silicosis after sustained inhalation of dust. Sandblasting may now only be performed in a controlled environment using ventilation, protective clothing and breathing air supply.

Other materials for sandblasting have been developed to be used instead of sand; for example, steel grit, steel shots, copper slag, glass beads (bead blasting), metal pellets, dry ice, corundum, and even ground coconut shells or corncobs.

The blast cleaning technique is used for the cleaning of various materials such as metal containers, boat hulls, bricks and concrete work. It is used for cleaning industrial as well as commercial structures.

There are many different techniques of blast cleaning, such as e.g. dry blasting and wet blasting.

Wet blasting has many advantages over dry blasting such as no dusting and blasting without surface damage. Wet blasting is accomplished by injecting the abrasive into a pressurized water stream or creating a slurry of abrasive and water that is pressurized or introduced into a compressed air stream.

However, there are many applications which need dry conditions, e.g. due to water-sensitivity of the surfaces or blasting material, in which cases wet blasting cannot be used.

Thus, there is a continuous need for dry blasting materials and techniques providing the maximum safety for the operator by minimum dusting, but at the same time effective cleaning without damaging the surfaces.

In the prior art there were several suggestions for improved blast cleaning, most of which however relate to wet blast cleaning or insufficient abrasive materials as blasting agents.

For example, DE 42 22 884 A1 relates to a method of smooth cleaning building facades by dry blasting, wherein an abrasive blasting agent is entrained in a pressurised air jet. However, the blasting agent consists of a mixture of glass pearls of 70 to 110 microns grain size, normal corundum of 44 to 74 micron grain size, and mixed corundum of 53 to 88 microns grain size, i.e. material not having dusting problems, but being very hard and sharp-edged, respectively, thus having a detrimental effect on a number of surfaces to be cleaned.

In U.S. Pat. No. 6,113,475 a method of cleaning a container is described and an apparatus therefor for cleaning a surface layer of the container by blasting fine particles of sodium bicarbonate with pressurized air into the container. However, sodium bicarbonate is a very soft material which is only suitable for very special coatings. Thus, it is also mentioned in this document that the method is used for the exfoliation of paint or the like, a prerequisite for which is that the surface to be cleaned must be very even in order to make exfoliation possible. Otherwise, the paints must be soft or unhardened. Furthermore, sodium bicarbonate is hygroscopic and soluble in water and therefore not suitable for the removal of aqueous or moist deposits from surfaces.

WO 94/07658 A1 relates to a blasting agent for removing coatings like paint, oxides, scales and the like from metals, alloys, composites and similar substrates, and a process for removing said coatings. The blasting agent comprises a precipitate or agglomerate of water-insoluble calcium carbonate, magnesium carbonate or mixtures thereof and 0-30 weight % alkali sulphate and/or magnesium sulphate. Preferably, the blasting agent is precipitated calcium carbonate or agglomerates thereof having a particle size of 10-200 μm, preferably 40 to 80 μm. According to the teaching of this document precipitates and agglomerates are essential for avoiding damages to the treated surfaces as it was found that natural water-insoluble carbonate particles like dolomite have a structure which is predominantly crystalline leaving profiles or grooves in the surface.

In U.S. Pat. No. 5,827,114 a slurry blasting process is described employing a liquid carrier medium containing a dispersed water-soluble particulate abrasive to enhance blast cleaning efficiency. The blasting agent however must be blasted in a liquid accelerator stream which may be aqueous or non-aqueous such as glycerine.

U.S. Pat. No. 5,531,634 relates to a method for blast cleaning a solid surface using an abrasive composition of calcium carbonate, wherein a coarse, medium, or fine grade of calcium carbonate having an average Mohs hardness of 4.25, i.e. a very hard kind of calcium carbonate can be used. The blasting medium can be pressurized air, but for the control of dust water is injected into the nozzle. The use of the different grades depends on the surface to be cleaned, i.e. the softer the surface, the finer the grade. The coarse grade can only be used for hard surfaces in view of the use of relatively hard calcium carbonate.

In EP 1 467 841 A1 a further process for removing a coating from a surface is suggested. This process is described as an erasing process which has to comply with a number of requirements. The erasing agent which may be made up of calcium carbonate comprises a plurality of particles in the form of precipitates or agglomerates and the blasting has to be carried out in a specific angle of incidence of the particles and the surface of between 0° and 60° is required in order to let the round precipitates or agglomerates roll along the surface and thus absorb the coating. Otherwise, the process will not work.

Thus, the processes of the prior art still have several drawbacks. Either the blasting material is too hard and causes damage to the surface to be cleaned, or too soft leading to dusting or poor cleaning performance.

Also, the processes using alkaline earth carbonates can only be controlled by additional material, time and energy consuming steps, such as the use of liquids, or the provision of the calcium carbonate in the form of precipitates or agglomerates in order to provide effective cleaning without dusting or damaging the surface.

Therefore, it is an object of the present invention to provide a process for the dry cleaning of solid surfaces causing little to no abrasion on the surface to be cleaned at a high cleaning efficiency and at low dust exposure.

Furthermore, it is an object of the present invention to provide mineral particles, which are suitable for the process according to the present invention, mineral particle of a natural source and as well as an easy method for the production of same.

The above object has been solved by a process for cleaning solid surfaces by dry blasting said surfaces with natural alkaline earth carbonate particles, having a median particle diameter of from 100 to 500 μm and a Mohs hardness of below 4, provided that the alkaline earth carbonate particles are not in the form of precipitates or agglomerates.

Natural alkaline earth carbonate which is especially suitable for the process of the invention is natural calcium carbonate and/or natural calcium magnesium carbonate and particularly natural alkaline earth carbonate being selected from the group comprising marble, chalk, dolomite, limestone and mixtures thereof.

Suitable natural alkaline earth carbonates for the present invention have an average Mohs hardness of preferably from 2.6 to 3.9, especially preferably from 2.6 to 3.4, e.g. 3.

The Mohs scale of hardness characterizes the scratch resistance of various minerals through the ability of a harder material to scratch a softer material. It was created in 1812 by the German mineralogist Friedrich Mohs and is one of several definitions of hardness in material science. Mohs based the scale on ten minerals that are all readily available. As the hardest known naturally occurring substance, diamond is at the top of the scale having a Mohs hardness of 10. The hardness of a material is measured against the scale by finding the hardest material that the given material can scratch, and/or the softest material that can scratch the given material. For example, if some material is scratched by apatite (5) but not by fluorite (4), its hardness on the Mohs scale would fall between 4 and 5.

Particularly preferred is natural alkaline earth carbonate in the form of marble, especially dolomite containing marble, such as marble originating from South Tyrol (Italy), Kärnten (Austria) or Bergen (Norway).

Optionally, the natural alkaline earth carbonate can contain commonly used additives, such as e.g. dry grinding aids and/or wetting agents.

The alkaline earth carbonate content in the natural alkaline earth carbonate mineral is preferably >90 wt.-%, more preferably 95 to 99.9 wt.-%, e.g. 99.5 wt.-%.

The minerals suitable for the present invention furthermore can have a portion, which is insoluble in hydrochloric acid, in an amount of ≤10 wt.-%, preferably ≤5 wt.-%, more preferably ≤2.7 wt.-%, e.g. 0.5 wt.-%.

Preferred natural alkaline earth carbonate for the use in the present invention has a calcium content of at least 21 wt.-%, preferably >35 wt.-%, more preferably >38 wt.-%.

Preferred natural alkaline earth carbonate for the use in the present invention has a magnesium content of maximum 13 wt.-%, preferably <3 wt.-%, more preferably <1.5 wt.-%.

It is furthermore advantageous that the natural alkaline earth carbonate comprises dolomite in an amount of from 0.1 to 100 wt.-%, preferably from 2 to 10 wt.-%, more preferably from 3 to 7 wt.-%, e.g. 5 wt.-%.

The alkaline earth carbonate used in the process of the present invention is essentially dry. "Essentially dry" in the sense of the present invention means a water content of below 5 wt.-%, preferably below 1 wt.-%, particularly below 0.1 wt.-% based on the weight of the alkaline earth carbonate and measured after drying at 105° C. for 3 h in an oven until the weight is constant. If the water content is higher than 5 wt.-%, the sieving and/or classification step in the production of the alkaline earth carbonate particles might be negatively influenced.

The natural alkaline earth carbonate particles are preferably produced by dry crushing, dividing and/or grinding in a hammer mill to a top cut size of 99 wt.-%<7 mm.

The grinding may be performed in any other known grinding equipments with which those skilled in the art are familiar for the coarse grinding of natural alkaline earth carbonate. For example, conventional ball mills, autogenous or non-autogenous milling, are suitable for dry grinding the alkaline earth particles used in the present invention.

In view of the fact that the content of fines should be as low as possible in order to avoid dusting, combinations of such mills or combinations of one or more such mills with cyclones and sieves are most suitable.

Screening with a sieve or screen, such as a metal screen, is most preferred for reducing fines, as well as air fractionation by centrifugal force such as in a cyclone and/or selector. Optionally, fines are washed off or extracted with a non-reacting liquid such as water.

For example, for obtaining marble particles having the desired particle size, marble pieces may be comminuted in a hammer mill to a particle size of not more than 7 mm followed by screening at 0.5 mm. The fine fraction is treated by air cyclone and/or an air selector to reduce most of the fines having a particle size of smaller than 0.05 mm, better most of the fines <0.09 mm or 0.1 mm.

It is preferred that, after the combination step, the alkaline earth carbonate powder obtained can be further classified by sieving using well known standard screens of defined mesh size for example as described in ISO 787/7.

The classification preferably provides the following fineness:

- the residue on a 500 μm sieve preferably is ≤10 wt.-%, more preferably ≤8 wt.-%, most preferably ≤5 wt.-%, e.g. 3 to 4 wt.-%, and/or
- the residue on a 200 μm sieve preferably is from 20 to 60 wt.-%, more preferably from 25 to 50 wt.-%, most preferably from 30 to 40 wt.-%, e.g. 35 wt. %; and/or
- the residue on a 90 μm sieve preferably is from 50 to 95 wt.-%, more preferably from 70 to 92 wt.-%, especially from 73 to 90 wt.-%, e.g. 80 wt.-%; and/or
- the residue on a 45 μm sieve preferably is ≥90 wt.-%, more preferably ≥93 wt.-%, most preferably ≥95 wt.-%, especially from 97 to 99 wt.-%, e.g. 98 wt.-%.

It is especially preferred that from 50 to 80 wt.-%, preferably from 60 to 80 wt.-%, e.g. 65 wt.-% of the natural alkaline earth carbonate particles have a particle size of between 90 to 500 μm.

The median particle diameter of the natural alkaline earth carbonate particles preferably is from 110 to 400 μm, more preferably from 130 to 300 μm, particularly from 135 to 200 μm, most preferably from 137 to 165 μm, e.g. from 142 to 165 μm measured according to the screening method using ISO screens of defined size. The results are drawn into a xy-graph.

By the use of natural alkaline earth carbonate such as natural marble, no agglomeration or precipitation steps are needed for obtaining particles having an effective size and form in dry blast cleaning, thus providing a more economic and ecologic way of cleaning solid surfaces by dry blasting.

Cleaning in the sense of the present invention means the removal of any kind of coatings from solid surfaces by the treatment with alkaline earth carbonate according to the present invention. Coatings which can be removed are e.g. selected from the group comprising paints, food residues such as e.g. milk or chocolate, pharmaceutical residues in containers or vessels, oils and tar substances, gas condensates, etc.

By the process according to the invention many kinds of solid surfaces can be cleaned, e.g. surfaces comprising materials selected form the group comprising steel, glass, wood and concrete.

Due to the special form and size of the alkaline earth carbonate particles it is possible to clean the surfaces very effectively without damaging the surface.

Thus, it is especially advantageous to use the process of the present invention in the field of food, oil, pharmaceutical and chemical industry, where there is a continuous need for effective cleaning of production or reaction vessels. However, it can also be used for removing paint such as graffiti or weathering or air pollution products such as soot from walls.

According to the process of the invention there is generally no restriction with respect to the angle with which the alkaline earth carbonate is blasted against the surface. It is preferred that the angle of incidence of the alkaline earth carbonate particles relative to the surface to be cleaned is from 1 to 90°, preferably 30 to 90°, more preferably 40 to 90°, e.g. 45°. Good results can also be achieved at an angle of more than 60° to 90°.

For the blasting operation any blasting equipment suitable for dry blasting can be used, such as for example a sand blasting gun of the "STAR" type supplied by the company ASTURO, Assago, Italy.

The compressed air pressure may be from 0.5 to 250 bar, preferably 1 to 7 bar, more preferably 2 to 6 bar, e.g. 5 bar.

In this respect, any commonly employed nozzles can be used, e.g. having a round or elliptic, square or rectangular shape. Preferably the nozzle is made of metal, glass or plastic, particularly of rubber gum.

Preferably the surface roughness (determined in μm depth using a three-dimensional laser microscope of the type ZEISS LSM 5 Pascal+Imager.Z1m) of the solid surface before and after the treatment remains unchanged. In any case, the surface roughness after the treatment according to the present invention is not more than twice as high than before, preferably not more than 1.5 times higher, more preferably not more than 1.2 times higher.

A further advantage of the process according to the present invention is that the natural alkaline earth carbonate has very favourable characteristics with respect to dusting.

In view of the above advantages, the use of natural alkaline earth carbonate particles having a mean particle diameter of from 100 to 500 μm and a Mohs hardness of below 4 for a process for cleaning solid surfaces as defined above is a further aspect of the invention, provided that the alkaline earth carbonate particles are not in the form of precipitates or agglomerates.

A further aspect of the present invention is the process for their production comprising the steps of dry crushing, dividing and/or grinding the natural alkaline earth carbonate, and screening the resulting particles for reducing the fines, which is described in more detail above.

The following figures, examples and tests will illustrate the present invention, but are not intended to limit the invention in any way.

EXAMPLES

The experiments were carried out with a sand blasting gun of the "STAR" type supplied by the company ASTURO, Assago, Italy using nozzles having a round and rectangular shape, respectively. The compressed air pressure was 5 bar. The distance between the nozzle and the test piece was about 5 cm (±0.5 cm). The treated surface area was about 2500±500 $mm^2$. The surface was examined before and after the treatment by means of an optical scanner. The surface roughness was determined using a three-dimensional laser microscope of the type ZEISS LSM 5 Pascal+Imager.Z1m. For determining the depth in μm, the root mean square deviation of all of the z-values was determined.

1. Comparative Examples

Comparative Example 1

Figure 1:
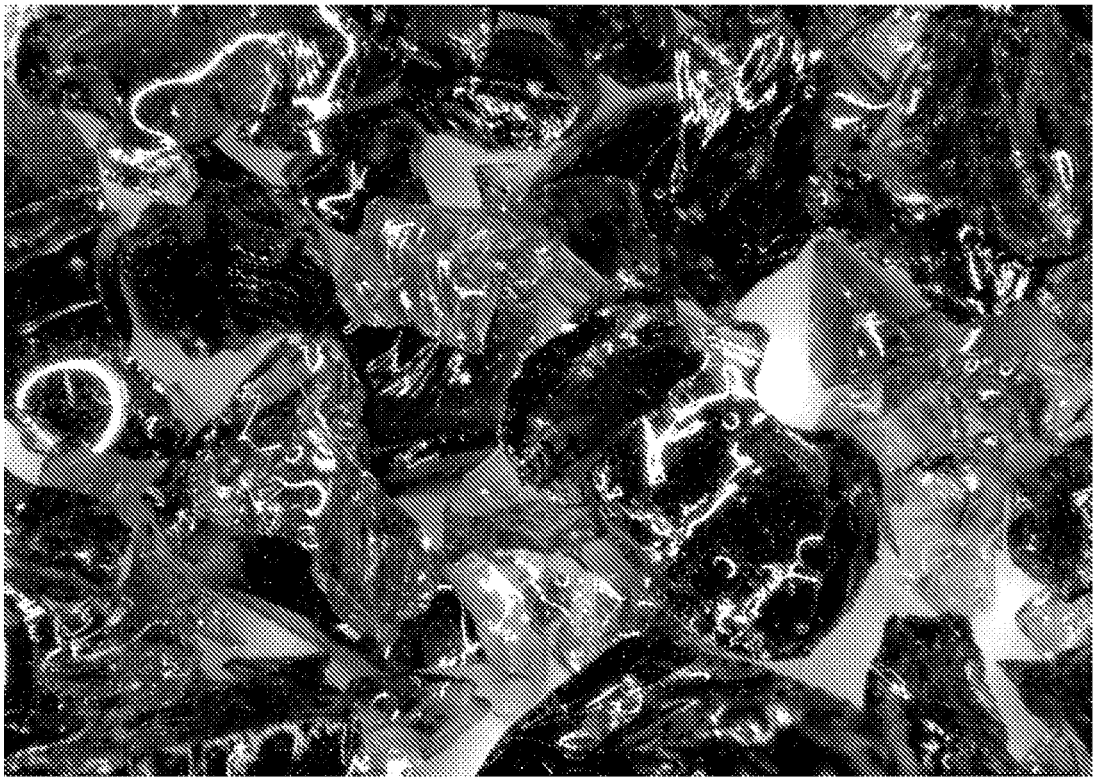
FIG. 1 is a stereomicroscopic picture of corundum particles of Example 1 at a magnification of 20×.

| | |
|---|---|
| Support: | Stainless sheet steel (V2A), surface roughness: 1.0 μm |
| Coating: | $TiO_2$ paint comprising highly cross-linked polyester/acrylate/isocyanate as a binder. |
| Treating medium: | Corundum; particle size: 200-800 μm (see FIG. 1); Mohs hardness: 9 |
| Nozzle used: | 6 mm × 25 mm |
| Angle of incidence: | 90° relative to the surface (i.e. perpendicular to the surface) |
| Treating time: | 30 s |

Results:

| | |
|---|---|
| Treated surface in $mm^2$: | 2262 |
| Cleaned surface in $mm^2$: | 999 |
| Ratio (treated surface/cleaned surface): | 2.26 |
| Surface roughness: | 6.5 μm |
| Dusting during application: | low |

The results show that corundum, which is a rather sharp-edged abrasive aluminium oxide, is a very effective cleaning medium on hard surfaces like steel sheets.

Comparative Example 2

| | |
|---|---|
| Support: | Stainless sheet steel (V2A), surface roughness: 1.0 μm |
| Coating: | $TiO_2$ paint comprising highly cross-linked polyester/acrylate/isocyanate as a binder. |
| Treating medium: | Natural calcium carbonate (marble containing dolomite from South Tyrol, Italy); median particle diameter: 10 μm (determined by the sedimentation method in an aqueous solution of 0.1 wt % $Na_4P_2O_7$ with a Sedigraph ™ 5100 of Micromeritics Instrument Corporation) Mohs hardness: about 3 |
| Nozzle used: | 6 mm × 25 mm |
| Angle of incidence: | 90° relative to the surface (i.e. perpendicular to the surface) |
| Treating time: | 30 s |

Results:

| | |
|---|---|
| Treated surface in $mm^2$: | 2500 |
| Cleaned surface in $mm^2$: | no determinable cleaning effect |
| Ratio (treated surface/cleaned surface): | not determinable |
| Surface roughness: | not detectable |
| Dusting during application: | extreme; visibility strongly reduced |
| Bulk Density: | 0.67 g/ml |

(The bulk density was calculated by measuring the volume of 100 g of product in a 100 ml graduated beaker (1 ml graduation))

The results show that calcium carbonate particles having a relatively fine particle diameter such as 10 μm are not effective in cleaning solid surfaces.

Comparative Example 3

| | |
|---|---|
| Support: | Stainless sheet steel (V2A), surface roughness: 1.0 μm |
| Coating: | $TiO_2$ paint comprising highly cross-linked polyester/acrylate/isocyanate as a binder. |
| Treating medium: | Natural calcium carbonate (marble containing dolomite from South Tyrol, Italy); sieve fraction: 2000-3500 μm; median particle diameter: 2700 μm<br>Mohs hardness: about 3 |
| Nozzle used: | 6 mm × 25 mm |
| Angle of incidence: | 90° relative to the surface (i.e. perpendicular to the surface) |

Results:

| | |
|---|---|
| Surface roughness: | not detectable (particles too coarse to spray. |
| Dust during application: | not applicable, particles too coarse to spray |
| Bulk Density: | 1.55 g/ml |

(The bulk density was calculated by measuring the volume of 100 g of product in a 100 ml graduated beaker (1 ml graduation))

The particles were too coarse to be sprayed; experiment was abandoned. Thus, also particles having a large diameter cannot be used effectively in blast cleaning.

Comparative Example 4

| | |
|---|---|
| Support: | Stainless sheet steel (V2A), surface roughness: 1.0 μm |
| Coating: | $TiO_2$ containing paint comprising highly cross-linked polyester/acrylate/isocyanate as a binder. |
| Treating medium: | Natural calcium carbonate (marble containing dolomite from South Tyrol, Italy)<br>Mohs hardness: about 3<br>Median particle diameter: ≅700 μm<br>Particle size distribution (determined by sieving according to ISO 787/7):<br>>1250 μm 2 wt.-%<br><500 μm 4 wt.-% |

-continued

| | |
|---|---|
| Nozzle used: | 6 mm × 25 mm |
| Angle of incidence | 90° relative to the surface (i.e. perpendicular to the surface) |
| Treating time: | 30 s |

Results:

| | |
|---|---|
| Treated surface in $mm^2$: | 2712 |
| Cleaned surface in $mm^2$: | 951 |
| Ratio (treated surface/cleaned surface): | 2.85 |
| Surface roughness: | 2.19 μm |
| Dusting during application: | very low dusting |
| Bulk Density: | 1.41 g/ml |

(The bulk density was calculated by measuring the volume of 100 g of product in a 100 ml graduated beaker (1 ml graduation))

The results show that the cleaning effect using calcium carbonate particles having a diameter of 700 μm and the above mentioned particle size distribution are nearly as effective as corundum particles. Cleaning with these calcium carbonate particles provides for a much lower surface roughness, but still more than twice as much as surface roughness than the untreated material.

Comparative Example 5

| | |
|---|---|
| Support: | Sheet of glass |
| Coating: | Whole milk having a water content of about 87.5 wt-%, dried to a water content of about 3 wt-% in 12 hours in a drying oven at 110° C. |
| Treating medium: | Corundum; particle size: 200-800 μm<br>Mohs hardness: 9 |
| Nozzle used: | Round; diameter: 10 mm |
| Angle of incidence: | 45° relative to the surface |
| Treating time: | 75 g of treating medium in about 10 s |

Results:

| | |
|---|---|
| Treated surface in $mm^2$: | ~4000 |
| Cleaned surface in $mm^2$: | >3000 |
| Ratio (treated surface/cleaned surface): | <5.33 |
| Surface roughness: | strong damaging of the glass surface |
| Dust during application: | little |

The dried milk coating was completely removed; however the surface of the sheet of glass was strongly damaged, scratched and matt by the hard corundum particles (visually detectable at a distance of 15 to 30 cm).

2. Examples According to the Invention

Inventive Example 6

| | |
|---|---|
| Treating medium: | Natural calcium carbonate (marble from South Tyrol, Italy, containing 6-7 wt.-% dolomite (calculated by analysing the Mg content by ICP |

-continued

Figure 2:
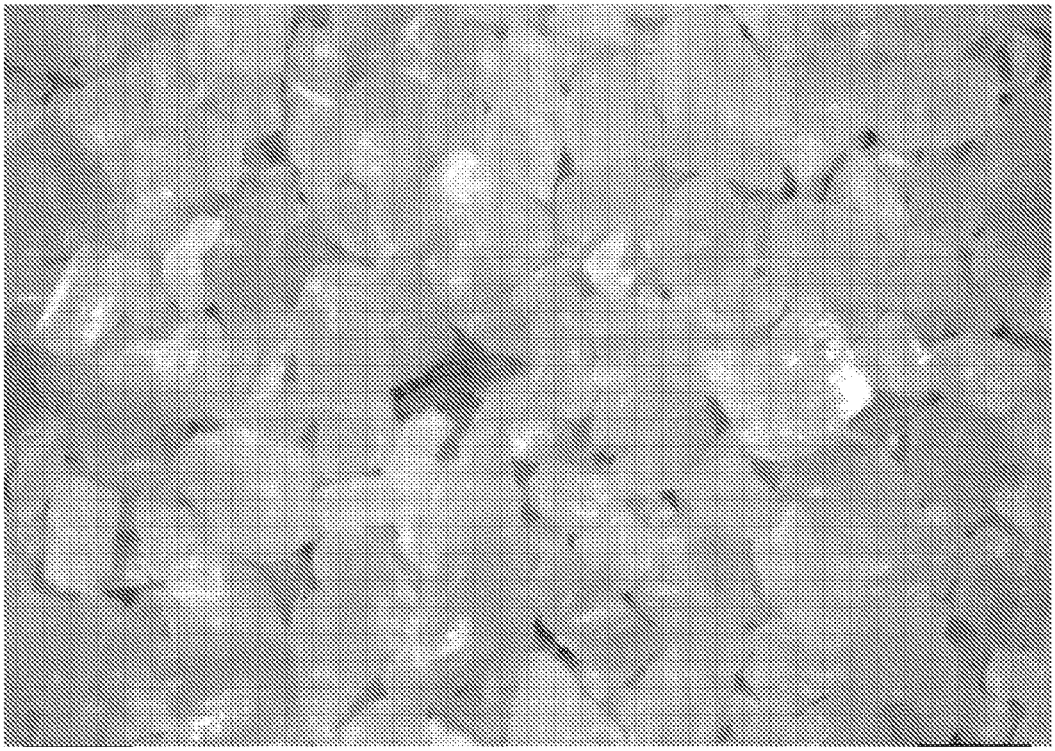
FIG. 2 is a stereomicroscopic picture of alkaline earth carbonate particles of Example 6 at a magnification of 20×.
Figure 3:
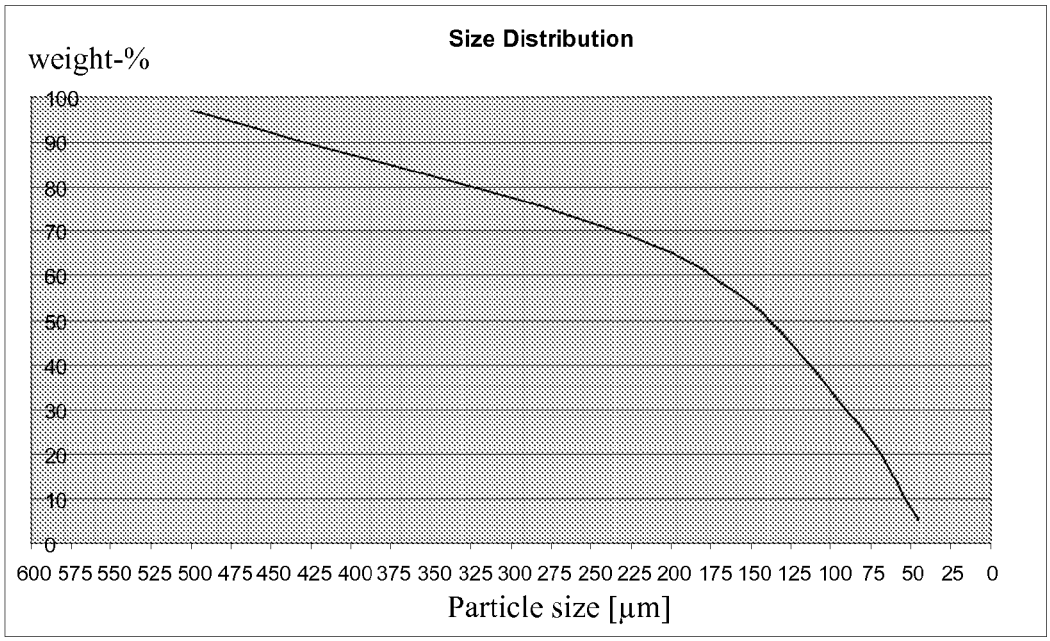
FIG. 3 shows the particle size distribution curve of alkaline earth carbonate particles of example 6.

| | |
|---|---|
| in HCl extract)); cf FIG. 2 | |
| Mohs hardness: about 3 | |
| HCl insolubles: 2.7 wt % | |
| Humidity: 0.08 to 0.12 wt.-% | |
| Median particle diameter: 137 μm (cf. FIG. 3) | |
| Particle size distribution (determined by sieving according to ISO 787/7): | |
| >500 μm | 3 wt.-% |
| >200 μm | 35 wt.-% |
| <90 μm | 30 wt.-% |
| <45 μm | 5 wt.-% |

Test a)

| | |
|---|---|
| Support: | Stainless sheet steel (V2A), surface roughness: 1.0 μm |
| Coating: | $TiO_2$ paint comprising highly cross-linked polyester/acrylate/isocyanate as a binder. |
| Nozzle used: | 6 mm × 25 mm |
| Angle of incidence: | 90° relative to the surface (i.e. perpendicular to the surface) |
| Treating time: | 30 s |

Results:

| | |
|---|---|
| Treated surface in $mm^2$: | 2327 |
| Cleaned surface in $mm^2$: | 276 |
| Ratio (treated surface/cleaned surface): | 8.44 |
| Surface roughness: | 1.5 μm |
| Dust during application: | little |
| Bulk density: | 1.45 |

(The bulk density was calculated by measuring the volume of 100 g of product in a 100 ml graduated beaker (1 ml graduation))

The results of test a) show that the cleaning effect using calcium carbonate particles having a median diameter of 137 μm and the above mentioned particle size distribution are not as effective as with corundum particles. However cleaning with calcium carbonate particles according to the invention is much smoother with respect to the surface to be cleaned Test b)

| | |
|---|---|
| Support: | Stainless sheet steel (V2A), surface roughness: 1.0 μm |
| Coating: | Whole milk having a water content of about 87.5 wt-%, dried to a water content of about 3 wt-% in 12 hours in a drying oven at 110° C. |
| Nozzle used: | 6 mm × 25 mm |
| Angle of incidence: | 45° relative to the surface |
| Treating time: | 30 s |

Results:

| | |
|---|---|
| Treated surface in $mm^2$: | 500 |
| Cleaned surface in $mm^2$: | >400 |
| Ratio (treated surface/cleaned surface): | <1.25 |
| Surface roughness: | 1.0-1.2 μm |
| Dust during application: | little |

The results of test b) show that the cleaning effect using calcium carbonate particles having a median diameter of 137 μm and the above mentioned particle size distribution are only slightly less effective as with corundum particles. However cleaning with calcium carbonate particles according to the invention is much smoother with respect to the surface to be cleaned. The surface roughness is nearly unchanged.

Test c)

| | |
|---|---|
| Support: | Plate of window glass |
| Coating: | Whole milk having water content of about 87.5 wt. %, dried to a water content of about 3 wt. % in 12 hours in a drying oven at 110° C. |
| Nozzle used: | 6 mm × 25 mm |
| Angle of incidence: | 45° relative to the surface |
| Treating time: | about 30 s |

Results:

The dried milk coating was completely removed; while the glass surface remained intact (no haze detectable visually at a distance of 15 to 30 cm).

| | |
|---|---|
| Dust during application: | little |

Inventive Example 7

| | |
|---|---|
| Support: | Stainless sheet steel (V2A), surface roughness: 1.0 μm |
| Coating: | $TiO_2$ paint comprising highly cross-linked polyester/acrylate/isocyanate as a binder. |
| Treating medium: | Natural calcium carbonate (marble containing dolomite from South Tyrol, Italy; cf. Example 6 washed to reduce fines <45 μm |
| | Mohs hardness: about 3 |
| | Humidity: 0.08 to 0.12 wt.-% |
| | Median particle diameter: 142 μm |
| | Particle size distribution (determined by sieving according to ISO 787/7): |
| | >500 μm 3 wt.-% |
| | >200 μm 35 wt.-% |
| | <90 μm 27 wt.-% |
| | <45 μm 2 wt.-% |
| Nozzle used: | 6 mm × 25 mm |
| Angle of incidence: | 90° relative to the surface (i.e. perpendicular to the surface) |
| Treating time: | 30 s |

Results:

| | |
|---|---|
| Treated surface in $mm^2$: | 2186 |
| Cleaned surface in $mm^2$: | 418 |
| Ratio (treated surface/cleaned surface): | 5.23 |
| Surface roughness: | 1.2 μm |
| Dust during application: | very little |
| Bulk density: | 1.50 |

(The bulk density was calculated by measuring the volume of 100 g of product in a 100 ml graduated beaker (1 ml graduation))

Even less dust was observed during surface cleaning compared with the unwashed sample of Example 6 a). Furthermore the results show that the cleaning effect using calcium carbonate particles having a median diameter of 142 μm and the above mentioned particle size distribution are more effective as with the calcium carbonate particles of Example 6, achieving the same or even better surface roughness of the solid surface after cleaning, i.e. effective cleaning at low dusting and very low surface damage is possible with the inventive process.

Inventive Example 8

| | |
|---|---|
| Support: | Stainless sheet steel (V2A), surface roughness: 1.0 μm |
| Coating: | $TiO_2$ paint comprising highly cross-linked polyester/acrylate/isocyanate as a binder. |
| Treating medium: | Natural calcium carbonate (marble containing dolomite from South Tyrol, Italy)<br>Mohs hardness: about 3<br>Humidity: 0.08 to 0.12 wt.-%<br>Median particle diameter: 200 μm<br>Particle size distribution (determined by sieving according to ISO 787/7):<br>>500 μm 4 wt.-%<br>>200 μm 50 wt.-%<br><90 μm 8 wt.-%<br><45 μm 1 wt.-% |
| Nozzle used: | 6 mm × 25 min |
| Angle of incidence: | 90° relative to the surface (i.e. perpendicular to the surface) |
| Treating time: | 30 s |

Results:

| | |
|---|---|
| Treated surface in $mm^2$: | 2908 |
| Cleaned surface in $mm^2$: | 2414 |
| Ratio (treated surface/cleaned surface): | 1.21 |
| Surface roughness: | 1.4 μm |
| Dust during application: | very little |

The results show that the sample having a median diameter of 200 μm and a high weight fraction of between 200 to 500 μm provide even better results with respect to cleaning efficiency and low dusting compared with the samples with a median diameter of 137 and 142 μm, respectively. The surface roughness is about the same.

Inventive Example 9

| | |
|---|---|
| Support: | Plate of glass |
| Coating: | Whole milk having a water content of about 87.5 wt-%, dried to a water content of about 3 wt-% in 12 hours in a drying oven at 110° C. |
| Treating medium: | Natural calcium carbonate (marble containing dolomite from South Tyrol, Italy)<br>Mohs hardness: about 3<br>Humidity: 0.08 to 0.12 wt.-%<br>Median particle diameter: 200 μm (see FIGS. 3 to 5)<br>Particle size distribution (determined by sieving according to ISO 787/7):<br>>500 μm 4 wt.-%<br>>200 μm 50 wt.-%<br><90 μm 8 wt.-%<br><45 μm 1 wt.-% |
| Nozzle used: | 6 mm × 25 mm |
| Angle of incidence: | 45° relative to the surface |
| Treating time: | 23 g treatment agent in about 10 s |

Results:

The dried milk coating was completely removed; while the glass surface remained intact (no haze detectable visually at a distance of 15 to 30 cm).

| | |
|---|---|
| Dust during application: | little |

The invention claimed is:

1. A process for cleaning a solid surface comprising the steps of:

(a) obtaining natural alkaline earth carbonate particles having a mean particle diameter of from 100 to 500 μm, a Mohs hardness of below 4, and classified as providing a residue on a 500 μm sieve of ≤10 wt.-%, a residue on a 200 μm sieve of from 20 to 60 wt.-%, a residue on a 90 μm sieve of from 50 to 95 wt.-%, and a residue on a 45 μm sieve of ≥90 wt.-%; and (b) dry blasting the surface with the natural alkaline earth carbonate particles from step (a) to clean the surface.

2. The process according to claim 1, wherein the natural alkaline earth carbonate particles comprise natural calcium carbonate and/or natural calcium magnesium carbonate.

3. The process according to claim 1, wherein the natural alkaline earth carbonate particles comprise marble, calcite, chalk, dolomite, limestone, or any mixture thereof.

4. The process according to claim 1, wherein the natural alkaline earth carbonate particles comprise marble.

5. The process according to claim 1, wherein the natural alkaline earth carbonate particles comprise marble containing dolomite.

6. The process according to claim 1, wherein the natural alkaline earth carbonate particles have an average Mohs hardness of from 2.6 to 3.9.

7. The process according to claim 1, wherein the natural alkaline earth carbonate particles have an average Mohs hardness of from 2.6 to 3.4.

8. The process according to claim 1, wherein the alkaline earth carbonate content in the natural alkaline earth carbonate particles is >90 wt.-%.

9. The process according to claim 1, wherein the alkaline earth carbonate content in the natural alkaline earth carbonate particles is 95 to 99.9 wt.-%.

10. The process according to claim 1, wherein the natural alkaline earth carbonate particles have a calcium content of at least 21 wt.-%.

11. The process according to claim 1, wherein the natural alkaline earth carbonate particles have a calcium content of >35 wt.-%.

12. The process according to claim 1, wherein the natural alkaline earth carbonate particles have a calcium content of >38 wt.-%.

13. The process according to claim 1, the natural alkaline earth carbonate particles have a magnesium content of maximum 13 wt.-%.

14. The process according to claim 1, the natural alkaline earth carbonate particles have a magnesium content of <3 wt.-%.

15. The process according to claim 1, the natural alkaline earth carbonate particles have a magnesium content of <1.5 wt.-%.

16. The process according to claim 1, wherein the natural alkaline earth carbonate particles comprise dolomite in a content of 0.1 to 100 wt.-%.

17. The process according to claim 1, wherein the natural alkaline earth carbonate particles comprise dolomite in a content of 2 to 10 wt.-%.

18. The process according to claim 1, wherein the natural alkaline earth carbonate particles comprise dolomite in a content of 3 to 7 wt.-%.

19. The process according to claim 1, wherein the natural alkaline earth carbonate particles are classified as providing a residue on a 500 μm sieve of ≤8 wt.-%.

20. The process according to claim 1, wherein the natural alkaline earth carbonate particles are classified as providing a residue on a 500 μm sieve of ≤5 wt.-%.

21. The process according to claim 1, wherein the natural alkaline earth carbonate particles are classified as providing a residue on a 500 μm sieve of 3 to 4 wt.-%.

22. The process according to claim 1, wherein the natural alkaline earth carbonate particles are classified as providing a residue on a 200 μm sieve of from 25 to 50 wt.-%.

23. The process according to claim 1, wherein the natural alkaline earth carbonate particles are classified as providing a residue on a 200 μm sieve of from 30 to 40 wt.-%.

24. The process according to claim 1, wherein the natural alkaline earth carbonate particles are classified as providing a residue on a 90 μm sieve of from 70 to 92 wt.-%.

25. The process according to claim 1, wherein the natural alkaline earth carbonate particles are classified as providing a residue on a 90 μm sieve of from 73 to 90 wt.-%.

26. The process according to claim 1, wherein the natural alkaline earth carbonate particles are classified as providing a residue on a 45 μm sieve of ≥93 wt.-%.

27. The process according to claim 1, wherein the natural alkaline earth carbonate particles are classified as providing a residue on a 45 μm sieve of ≥95 wt.-%.

28. The process according to claim 1, wherein the natural alkaline earth carbonate particles are classified as providing a residue on a 45 μm sieve of from 97 to 99 wt.-%.

29. The process according to claim 1, wherein 50 to 80 wt.-% of the natural alkaline earth carbonate particles have a particle size of between 90 to 500 μm.

30. The process according to claim 1, wherein 60 to 80 wt.-% of the natural alkaline earth carbonate particles have a particle size of between 90 to 500 μm.

31. The process according to claim 1, wherein the natural alkaline earth carbonate particles have a median particle diameter of from 110 to 400 μm.

32. The process according to claim 1, wherein the natural alkaline earth carbonate particles have a median particle diameter of from 130 to 300 μm.

33. The process according to claim 1, wherein the natural alkaline earth carbonate particles have a median particle diameter of from 135 to 200 μm.

34. The process according to claim 1, wherein the natural alkaline earth carbonate particles have a median particle diameter of from 137 to 165 μm.

35. The process according to claim 1, wherein the natural alkaline earth carbonate particles have a median particle diameter of from 142 to 160 μm.

36. The process according to claim 1, wherein the natural alkaline earth particles are obtained by dry grinding.

37. The process according to claim 1, wherein the natural alkaline earth particles are obtained by dry grinding in a ball mill or hammer mill.

38. The process according to claim 1, wherein the natural alkaline earth particles are obtained by dry grinding in combination with the use of cyclones and sieves.

39. The process according to claim 1, wherein the solid surface is cleaned of a material selected from the group consisting of paints, food residues and pharmaceutical residues.

40. The process according to claim 1, the solid surface is steel, glass, wood, or concrete.

41. The process according to claim 1, wherein the alkaline earth carbonate particles are applied at 1 to 90° relative to the surface to be cleaned.

42. The process according to claim 1, wherein the alkaline earth carbonate particles are applied at 30 to 90° relative to the surface to be cleaned.

43. The process according to claim 1, wherein the alkaline earth carbonate particles are applied at 40 to 90° relative to the surface to be cleaned.

44. The process according to claim 1, wherein the alkaline earth carbonate particles are applied at 60 to 90° relative to the surface to be cleaned.

45. A process for manufacturing natural alkaline earth carbonate particles useful for dry blasting a surface comprising the steps of dry crushing, dividing and/or grinding natural alkaline earth carbonate having an Mohs hardness of below 4 to obtain a medium particle diameter of from 100 to 500 μm, and screening the natural alkaline earth carbonate to obtain a natural alkaline earth carbonate that is classified as providing a residue on a 500 μm sieve of ≤10 wt.-%, a residue on a 200 μm sieve of from 20 to 60 wt.-%, a residue on a 90 μm sieve of from 50 to 95 wt.-%, and a residue on a 45 μm sieve of ≥90 wt.-%.

* * * * *